US008790505B2

(12) United States Patent
Shimotani et al.

(10) Patent No.: US 8,790,505 B2
(45) Date of Patent: Jul. 29, 2014

(54) METHOD FOR MANUFACTURING SILVER TRIANGULAR PYRAMID PARTICLES AND SILVER TRIANGULAR PYRAMID PARTICLES

(71) Applicant: Fuji Xerox Co., Ltd., Tokyo (JP)

(72) Inventors: Kei Shimotani, Kanagawa (JP); Jun Kawahara, Kanagawa (JP); Satoshi Tatsuura, Kanagawa (JP); Yasuo Yamamoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/688,684

(22) Filed: Nov. 29, 2012

(65) Prior Publication Data

US 2013/0126361 A1 May 23, 2013

Related U.S. Application Data

(62) Division of application No. 11/600,181, filed on Nov. 16, 2006, now abandoned.

(30) Foreign Application Priority Data

Jun. 9, 2006 (JP) ..... 2006-161177

(51) Int. Cl.
*C25C 1/20* (2006.01)
*C25C 5/02* (2006.01)

(52) U.S. Cl.
CPC .... *C25C 5/02* (2013.01); *C25C 1/20* (2013.01)
USPC ..... 205/566; 205/571

(58) Field of Classification Search
CPC ..... C25C 1/20; C25C 5/02
USPC ..... 205/566, 571
See application file for complete search history.

(56) References Cited

U.S. PATENT DOCUMENTS

| | | | | |
|---|---|---|---|---|
| 5,370,784 | A | 12/1994 | Kammel et al. | |
| 7,135,054 | B2 | 11/2006 | Jin et al. | |
| 7,273,537 | B2 | 9/2007 | Smedley et al. | |
| 7,501,288 | B2 | 3/2009 | Schultz et al. | |
| 7,585,349 | B2 | 9/2009 | Xia et al. | |
| 7,615,096 | B1 | 11/2009 | Tai et al. | |
| 2007/0284261 | A1 * | 12/2007 | Shimotani et al. | 205/571 |
| 2008/0003130 | A1 | 1/2008 | Xia et al. | |

FOREIGN PATENT DOCUMENTS

| | | |
|---|---|---|
| JP | A-11-101994 | 4/1999 |
| JP | A-2000-338528 | 12/2000 |
| JP | A-2004-018549 | 1/2004 |
| JP | A-2004-198451 | 7/2004 |

(Continued)

OTHER PUBLICATIONS

Liang et al., Synthesis of morphology-controlled silver nanostructures by electrodeposition, Nano-Micro Lett. 2, 6-10 (2010). doi: 10.5101/nml.v2il.p6-10.*

(Continued)

*Primary Examiner* — Holly Le
(74) *Attorney, Agent, or Firm* — Oliff PLC

(57) ABSTRACT

The present invention provides a method for manufacturing silver triangular pyramid particles including: forming an electric field in an electrolytic solution including silver ions and a surfactant to reduce the silver ions into silver triangular pyramid particles.

4 Claims, 11 Drawing Sheets

(56) References Cited

FOREIGN PATENT DOCUMENTS

| | | |
|---|---|---|
| JP | A-2004-346396 | 12/2004 |
| JP | A-2005-68448 | 3/2005 |
| JP | A-2005-092183 | 4/2005 |
| WO | WO 2004/086044 A1 | 10/2004 |

OTHER PUBLICATIONS

Yin et al., Electrochemical synthesis of silver nanoparticles under protection of poly(N-vinylpyrrolideone), J. Phys. Chem. B (2003) 107, 8898-8904.*

Harfenist et al., Highly Oriented Molecular Ag Nanocrystal Arrays, J. Phys. Chem. (1996), 100, 13904-13910.*

Bordenave et al., Plasmon-induced photochemical synthesis of silver triangular prisms and pentagonal bipyramids by illumination with light emitting diodes, Materials Chem. and Phys., 139 (2013) 100-106.*

Wang et al., Superlattices of self-assembled tetrahedral Ag Nanocrystals, Adv. Mater. (1998), No. 10, 808-812.

Marie-Paule Pileni, The role of soft colloidal templates in controlling the size and shape of inorganic nanocrystals, Nature Materials, vol. 2, Mar. 2003, 145-150.

Sun et al., Transformation of silver nanospheres into nanobelts and triangular nanoplates through a thermal process, Nano Lett. (2003), vol. 3, No. 5, 675-679.

Popov et al, Controlling silver nanoparticle size and morphology with photostimulated synthesis, available online Nov. 17, 2005 at arxir.org (http://arxiv.org/abs/[physics/0511147).

Wiley et al, Polyol Synthesis of Silver Nanoparticles: Use of Chloride and Oxygen to Promote the Formation of Single-Crystal, Truncated Cubes and Tetrahedrons, Nano Letters, 2004, 4 (9), pp. 1733-1739.

Nersisyan et al., A new and effective chemical reduction method for preparation of nanosized silver powder and colloid dispersion, Mat. Research Bulletin 38 (2003) 949-956.

Ma et al, Synthesis of Silver and Gold Nanoparticles by a Novel Electrochemical Method, ChemPhysChem (2004) 5, pp. 68-75.

Wiley et al, Right bipyramids of silver: A new shape derived from single twinned seeds, Nano Lett. vol. 6, No. 4, 765-768, 2006, published online Feb. 23, 2006.

Nov. 1, 2011 Japanese Office Action issued in Japanese Patent Application No. 2006-161177 (with translation).

* cited by examiner

METHOD FOR MANUFACTURING SILVER TRIANGULAR PYRAMID PARTICLES AND SILVER TRIANGULAR PYRAMID PARTICLES

This is a Divisional application of application Ser. No. 11/600,181 filed Nov. 16, 2006. The disclosure of the prior application is hereby incorporated by reference herein in its entirety.

BACKGROUND

1. Technical Field

The present invention relates to a method for manufacturing silver triangular pyramid particles and to silver triangular pyramid particles, and particularly to a method for manufacturing silver triangular pyramid particles to which method electrolytic deposition is applied and to silver triangular pyramid particles manufactured by the method.

2. Related Art

With recent progress in informalization, the amount of paper consumed as media for information transmission is increasing. Meanwhile, image display media that can repeatedly record and erase images and that are known as electronic paper have drawn attentions. In order to put such electronic paper into practical use, the electronic paper is required to be easily carried, to be light, to be not bulky (to be thin), as with ordinary paper and to rewrite information at low energy, to exhibit little deterioration during repeated rewriting and to have excellent reliability.

As a display technology suitably applied to such display media, there is a method for applying an electric field to an electrolytic solution including a metal salt such as a silver salt solution to deposit or dissolve a metal such as silver.

However, the shape of the metal particles deposited by applying the electric field deposition method using the above techniques is limited to a sphere.

SUMMARY

According to an aspect of the invention, there is provided a method for manufacturing silver triangular pyramid particles including: forming an electric field in an electrolytic solution including silver ions and a surfactant to reduce the silver ions into silver triangular pyramid particles.

According to an aspect of the invention, there is provided a silver particle having a triangular pyramid shape, which is a tetrahedron, in which the silver particle has only one light absorption peak corresponding to sides whose lengths are substantially the same (length (c)) in respective triangular planes. The "triangular pyramid shape" means an untruncated tetrahedron shape that is shown in FIG. 4A. As shown in FIG. 4A, the silver particle having a triangular pyramid shape of the invention has sides whose lengths are substantially the same (length (c)) in respective triangular planes.

BRIEF DESCRIPTION OF THE DRAWINGS

Exemplary embodiments of the invention will be described in detail based on the following figures, wherein.

DETAILED DESCRIPTION

The silver triangular pyramid particle of the invention may be manufactured by forming an electric field in an electrolytic solution containing silver ions and at least one surfactant to reduce the silver ions into silver particles.

In the following, a specific method for manufacturing the silver triangular pyramid particles of the invention will be described.

Figure 1A:
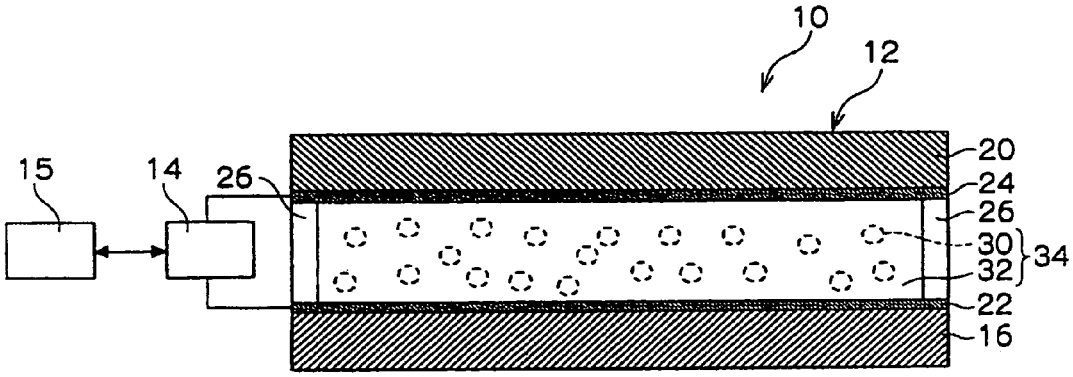
FIG. 1A is a sectional view schematically showing an example of an apparatus for manufacturing silver triangular pyramid particles of the invention in which silver triangular pyramid particles have not been deposited.

In the following method for manufacturing the silver triangular pyramid particles of the invention, a silver triangular pyramid particle manufacturing apparatus 10 shown in FIG. 1A is used.

The silver triangular pyramid particle manufacturing apparatus 10 has a reaction vessel 12 containing an electrolytic solution layer 34 filled with an electrolytic solution 32; a voltage application unit 14 for applying a voltage to the electrolytic solution layer 34; and a controller 15 for controlling the voltage application unit 14 to adjust the value of the voltage applied to the electrolytic solution layer 34.

The reaction vessel 12 has a rear substrate 16, a front substrate 20 facing the rear substrate 16 and spaced apart from the rear substrate 16, plural spacers 26, the electrolytic solution layer 34, a second electrode 22, and a first electrode 24.

When the rear substrate 16 and the front substrate 20 are made of an electrically conductive material, the front substrate 20 and the rear substrate 16 also function respectively as the second electrode 22 and the first electrode 24. Therefore, the second electrode 22 and the first electrode 24 may not be provided in this case.

The reaction vessel 12 has a structure in which the second electrode 22, the electrolytic solution layer 34, the first electrode 24, and the front substrate 20 are laminated in that order on the rear substrate 16.

The spacers 26 are provided between the rear substrate 16 and the front substrate 20 to maintain predetermined space between the rear substrate 16 and the front substrate 20 and to prevent the electrolytic solution 32 in the electrolytic solution layer 34 from leaking out of the reaction vessel 12.

The electrolytic solution layer 34 is regions (hereinafter referred to as "compartments" in some cases) surrounded by the second electrode 22 laminated on the rear substrate 16, the spacers 26, and the first electrode 24 laminated on the front substrate 20, and includes the electrolytic solution 32.

The voltage application unit 14 for forming an electric field in the electrolytic solution layer 34 by applying a voltage to the second electrode 22 and the first electrode 24 is electrically connected to the second electrode 22 and the first electrode 24 so that signals can be sent and received therebetween.

Figure 1B:
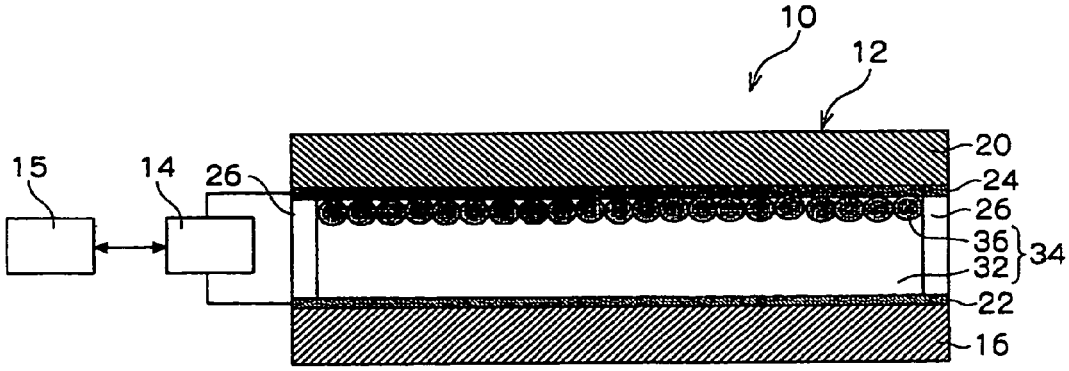
FIG. 1B is a sectional view showing a state in which silver triangular pyramid particles have been deposited in the apparatus of FIG. 1A.

To deposit silver triangular pyramid particles 36 (see FIG. 1B) on the front substrate 20 and the rear substrate 16, both the substrates are made of a material that is not degraded or corroded by the presence of the electrolytic solution and formation of an electric field, and otherwise there is no particular limit to the substrates.

Each of the front substrate 20 and the rear substrate 16 is preferably a film or sheet made of a polymer such as polyester (e.g. polyethylene terephthalate), polyimide, polymethyl methacrylate, polystyrene, polypropylene, polyethylene, polyamide, nylon, polyvinyl chloride, polyvinylidene chloride, polycarbonate, polyether sulfone, silicone resin, polyacetal resin, fluorinated resin, a cellulose derivative, or polyolefin; or an inorganic substrate such as a glass substrate, a metal substrate, or a ceramic substrate.

The spacers 26 may be made of any known resin material. However, the spacers 26 are preferably made of a photosensitive resin from the viewpoint of manufacture.

The spacers 26 may be particles. The particle size distribution thereof is preferably in a narrow range, and is preferably monodisperse. The spacers preferably have a light color, and more preferable white color. The spacers are preferably made of at least one of the above-described polymer, silicon dioxide and titanium oxide. When the spacers are particles, the surfaces of the particles are preferably treated with a finishing agent such a silane coupling agent or a titanate coupling agent in order to improve the dispersibility of the particles in a solvent and to protect the particles from a solvent.

The aforementioned members are bonded to each other through adhesive layers (not shown). There is no particular limit to the type of the material of the adhesive layers, and a thermosetting resin, or an ultraviolet ray curable resin may be used as such. However, a material which does not adversely affect the materials of the members of the reaction vessel 12 such as the spacers 26, and the electrolytic solution 32 contained in the electrolytic solution layer 34 is selected as the material of the adhesive layer.

It is unnecessary that the spacers 26 be bonded to the first electrode 24 and the second electrode 22. In this case, the reaction vessel 12 as a whole may be so immersed into a large quantity of the electrolytic solution layer 34 that a metal such as silver may be deposited in the electrolytic solution layer 34.

Each of the second electrode 22 and the first electrode 24 is preferably a layer made of a metal oxide such as tin oxide-indium oxide (ITO), tin oxide, or zinc oxide. Furthermore, each of the second electrode 22 and the first electrode 24 may be made of at least one of these materials or a laminated body made of at least two of these materials.

Desired thickness and size of each of the second electrode 22 and the first electrode 24 depend on the reaction vessel 12, and there are no particular limits thereto.

Next, the electrolytic solution layer 34 will be described.

The electrolytic solution layer 34 includes the electrolytic solution 32. The electrolytic solution 32 contains at least one surfactant, which will be described later, and silver ions 30 dissolved in the electrolytic solution 32.

The silver ions 30 are reduced by applying a voltage of deposition potential to the electrolytic solution layer 34 and silver triangular pyramid particles 36 (see FIG. 1B) are thereby deposited. When a voltage of dissolution potential is applied to the silver triangular pyramid particles deposited, the silver triangular pyramid particles are oxidized into the silver ions 30, which are dissolved in the electrolytic solution 32.

The deposition potential is potential capable of reducing the silver ions 30 dissolved in the electrolytic solution 32 into the deposited silver triangular pyramid particles 36, while the dissolution potential is potential capable of oxidizing at least a part of the silver triangular pyramid particles deposited into the silver ions 30 dissolved in the electrolytic solution 32.

Figure 2:
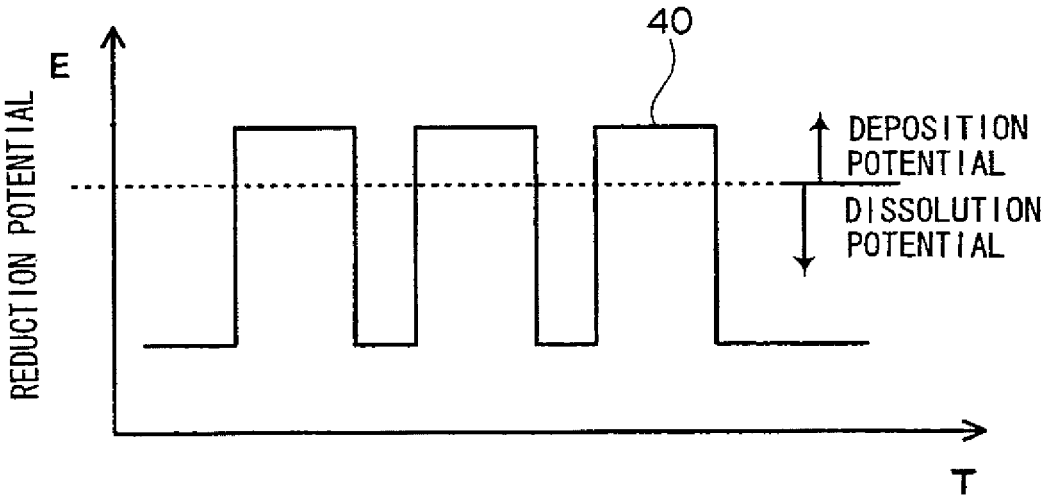
FIG. 2 is a diagram showing an example of a first voltage waveform.

More specifically, when a voltage equal to or higher than the reduction potential serving as the threshold between the deposition potential and the dissolution potential, or, in other words, the threshold at which the silver ions 30 are reduced is applied as shown in FIG. 2, silver triangular pyramid particles are deposited due to reductive reaction of the silver ions 30 in the electrolytic solution 32. On the other hand, when a voltage less than the reduction potential is applied, the silver triangular pyramid particles deposited are oxidized into the silver ions 30 dissolved in the electrolytic solution 32.

Here, the expression "voltage equal to or higher than the reduction potential" means voltage at which the reductive reaction of the silver ions 30 is dominant to the oxidative reaction of the silver triangular pyramid particles. The expression "voltage less than the reduction potential" means a voltage at which the oxidative reaction of the silver triangular pyramid particles is dominant to the reductive reaction of the silver ions 30.

The silver ions 30 contained in the electrolytic solution 32 can be obtained by using a compound containing silver as a raw material. There is no particular limit to the type of the compound containing silver. Examples thereof include silver nitrate, silver acetate, silver perchlorate, and silver iodide.

The silver ions 30 may be produced in the electrolytic solution layer 34 by dissolving any of these metal compounds in the electrolytic solution 32.

The electrolytic solution 32 contains at least one surfactant, as described previously.

The surfactant preferably has an alkyl main chain in the molecule. The alkyl main chain preferably has 1 to 20 carbon atoms, more preferably 2 to 18 carbon atoms, and still more preferably 4 to 16 carbon atoms.

Examples of such a surfactant include cationic surfactants such as amine salts, ammonium salts, and phosphates; anionic surfactants such as sulfonates; and nonionic surfactants. The surfactant is preferably a cationic surfactant in view of the electric charges of the silver ions.

Specific examples of the surfactant include, but are not limited to, tetramethylammonium bromide, tetraethylammonium bromide, tetrabutylammonium bromide, butyltriethylammonium bromide, tetraoctylammonium bromide, tetradodecylammonium bromide, dodecyltrimethylammonium bromide, and hexadecyltrimethylammonium bromide; and alkylammonium chlorides and alkylammonium iodides obtained by replacing the bromide of these tetraalkylammonium bromides with chloride or iodide; and alkylphosphonium bromides obtained by replacing the ammonium of the tetraalkylammoniumn bromides with phosphonium.

When any of the above-described surfactants is dissolved or dispersed in an electrolytic solution and an electric field is formed in the electrolytic solution, silver triangular pyramid particles may be deposited.

The amount of the surfactant(s) contained in the electrolytic solution in the invention is preferably about 1 part by weight to about 10,000 parts by weight, more preferably about 10 parts by weight to about 5,000 parts by weight, and still more preferably about 100 parts by weight to about 3000 parts by weight with respect to 100 parts by weight of silver ions.

When the amount of the surfactant(s) contained in the electrolytic solution is less than about 1 part by weight with respect to 100 parts by weight of silver ions, the deposited particles cannot be completely covered with the surfactant, making it difficult to control the shapes of the silver particles. When the amount of the surfactant(s) exceeds about 10,000 parts by weight, it becomes difficult to completely dissolve the surfactant in the electrolytic solution.

The electrolytic solution 32 of the electrolytic solution layer 34 contains silver ions 30, at least one surfactant, and a solvent for dissolving the silver ions 30, and otherwise there is no particular limit thereto. However, the electrolytic solution 21 may further contain a variety of materials, if necessary.

The solvent may be water, alcohol such as methanol, ethanol, or isopropyl alcohol, or other non-aqueous solvent (e.g., an organic solvent). One of these solvents may be used alone or two or more of them can be used together.

The non-aqueous solvent is, for example, an aprotic non-aqueous solvent. Examples thereof include ethylene carbonate, propylene carbonate, butylene carbonate, dimethyl carbonate, diethyl carbonate, ethyl methyl carbonate, methyl acetate, ethyl acetate, ethyl propionate, dimethylsulfoxide, γ-butyrolactone, dimethoxyethane, diethoxyethane, tetrahydrofuran, formamide, dimethylformamide, diethylformamide, dimethylacetamide, acetonitrile, propionitrile, and methylpyrrolidone; and silicone oils.

The electrolytic solution 32A may contain at least one additive, such as a water-soluble resin, and/or polymer particles. More specifically, the solvent is so selected as to dissolve silver ions and as to dissolve or disperse an electrolytic material, a polymer, and/or a surfactant.

Examples of the water-soluble resin include polyalkylene oxides such as polyethylene oxide; polyalkylene imines such as polyethylene imine; and polymers such as polyethylene sulfide, polyacrylate, polymethyl methacrylate, polyvinylidene fluoride, polycarbonate, polyacrylonitrile, and polyvinyl alcohol. One of these resins may be used alone or two or more of them can be used together.

Control of the travel speed of the metal ions in the electrolytic solution layer, and stabilization of the silver triangular pyramid particles deposited can be achieved by dissolving or dispersing such a water-soluble resin in the electrolytic solution. The amount of the water-soluble resin contained may be appropriately adjusted on the basis of the type(s) of the metal ions and/or the amounts of other components.

The electrolytic solution 32 preferably contains the counter ions for the metal ions.

The counter ions allow the silver ions 30 to stably exist in the electrolytic solution 32, unless the above-described deposition voltage is applied to the electrolytic solution layer. Otherwise there is no particular limit to the counter ions. Examples thereof include fluorine ions, chlorine ions, bromine ions, iodine ions, perchloric ions, and fluoroborate ions.

The controller 15 controls the voltage application unit 14 so that the voltage application unit 14 applies a predetermined voltage to the electrolytic solution layer 34. When a voltage having a first voltage waveform is applied to the electrolytic solution layer 34, an electric field is formed in the electrolytic solution 32 of the electrolytic solution layer 34 and the silver triangular pyramid particles of the invention are deposited.

The predetermined voltage may be the voltage of the aforementioned deposition potential. Preferably, the predetermined voltage is a voltage that varies periodically between the deposition potential and the dissolution potential as shown in FIG. 2, and in which a relationship between a period of time T1 during which the deposition potential is continued and a period of time T2 during which the dissolution potential is continued is represented by a voltage waveform satisfying the following relationship.

$$100(\%) > \frac{T1}{T1 + T2} \times 100 > 50(\%) \qquad \text{Expression (1)}$$

It is necessary that the value of T1×100/(T1+T2) in the expression (1) be more than about 50 and less than 100. However, the value is preferably within the range of from about 55 to about 95, and more preferably within the range of from about 60 to about 90.

When the value of T1×100/(T1+T2) in the expression (1) is 100%, the dissolution potential is not contained in the first voltage waveform, and silver triangular pyramid particles, which may have uneven sizes, are deposited. When the value is about 50% or less, the continuous voltage application time T2 of the dissolution potential becomes longer than the continuous voltage application time T1 of the deposition potential, and thus, and the dissolution is dominant to the deposition, resulting in no deposition of the silver triangular pyramid particles due to application of the voltage having the first voltage waveform.

When the voltage having the first voltage waveform is applied to the electrolytic solution layer 34, the reductive reaction of the silver ions 30 dissolved in the electrolytic solution 32 proceeds during a period of time (time T1) when the application of a voltage of the deposition potential is continued, whereby the silver ions 30 are reduced to deposit silver triangular pyramid particles. On the other hand, the oxidative reaction of the silver triangular pyramid particles deposited proceeds during a period of time (time T2) when the application of a voltage of the dissolution potential is continued, whereby small silver triangular pyramid particles deposited are oxidized and dissolved in the electrolytic solution 32 as silver ions 30 and disappear, and large triangular pyramid particles dwindle.

Thus, when the voltage having the first voltage waveform is applied to the electrolytic solution layer 34, deposition of silver triangular pyramid particles and dissolution of the silver triangular pyramid particles occur periodically. Moreover, since the time T1 during which the voltage of the deposition potential is continuously applied is longer than the time T2 during which the voltage of the dissolution potential is continuously applied, deposition of silver triangular pyramid particles having less uneven sizes can be realized.

Although the first voltage waveform 40 is a rectangular waveform in FIG. 2, the first voltage waveform may also be any of a waveform having a flat portion in each of high and low potential portions, and sine wave-shaped and triangle wave-shaped waveforms in which potential changes continuously.

The frequency of the first voltage waveform is preferably about 10 Hz to about 100 MHz, more preferably about 50 Hz to about 10 MHz, and still more preferably about 100 Hz to about 1 MHz from the viewpoints of the diffusion speed of the silver ions and the reaction speed of redox.

The reduction potential, the shape (e.g., sine waveform, or rectangular waveform), and the frequency used to define the first voltage waveform 40 depend on the type of the electrolytic solution 32, the type of the second electrode 22 and the first electrode 24, and the thickness of the spacers 26 (i.e. a distance between the second electrode 22 and the first electrode 24).

More specifically, the reduction potential is determined by the type of the solvent for the silver ions 30 dissolved in the electrolytic solution 32, and the type(s) and the concentration of other additive(s).

Furthermore, the shape of the first voltage waveform 40 (e.g., sine waveform, or rectangular waveform), and the amplitude width of the first voltage waveform 40 with respect to the reduction potential are so determined as to reduce or oxidize the substances that are contained in the electrolytic solution and that are other than the silver ions as little as possible.

The application time of the voltage having the first voltage waveform may be continued until a desired amount of the silver triangular pyramid particles are deposited on the surface of the electrode.

In the aforementioned descriptions, an electric field is formed in the electrolytic solution 32 hermetically confined in a space formed by the front substrate 20, the rear substrate 16, and the spacers 26 to deposit silver triangular pyramid particles 36. However, the manufacturing device usable in the method for manufacturing silver triangular pyramid particles of the invention is not limited to such a device. It is necessary that the manufacturing device allows formation of an electric field in the electrolytic solution 32, and otherwise there is no particular limit to the manufacturing device.

When the voltage is applied to the electrolytic solution 32 of the electrolytic solution layer 34, the silver ions 30 in the electrolytic solution 32 may be reduced to deposit silver triangular pyramid particles.

The term "triangular pyramid" means a polyhedron having as each side a straight line or a curve, and triangular planes. The lengths of the longer sides of the triangular planes of the polyhedron are substantially the same.

The triangular pyramid particles, the lengths of the longer sides of the triangular planes of which are substantially the same means triangular pyramid particles that have only one light absorption peak rather than plural light absorption peaks. The light absorption peak(s) can be measured by a spectrophotometer.

The mechanism that deposits silver triangular pyramid particles has not become clear, but is supposedly thought to be as follows. The surfactant surrounds each of silver particles that are being deposited or the silver ions that are being reduced, so that transfer of electrons from the electrode to the silver ions is restricted by means of the length of the alkyl chain of the surfactant.

The average length of the longer sides of the silver triangular pyramid particles deposited is preferably about 1 to about 1000 nm, and more preferably about 2 to about 500 nm. Silver triangular pyramid particles each having a longer side within the range of from about 4 to about 100 nm are significant from the viewpoints of practicability and good color intensity.

The lengths of the sides of the silver triangular pyramid particles of the invention are calculated by analyzing the electron microscopic images of the silver triangular pyramid particles deposited.

The silver triangular pyramid particles deposited have a surface plasmon absorption peak in the visible light region, and exhibit a color (color-forming property) corresponding to the a surface plasmon absorption peak. The expression "having a surface plasmon absorption peak in the visible light region" means having a light absorption peak due to surface plasmon resonance of the silver triangular pyramid particles in the wavelength region of visible light, resulting in exhibition of a color (color-forming property) corresponding to the a surface plasmon absorption peak.

Such color originating from the surface plasmon absorption is observed in so-called nanoparticles having longer sides of around several nm to several ten nm, and such particles have high chroma, high absorbance and excellent durability.

Moreover, the light absorption peak due to plasmon absorption appears at a wavelength corresponding to the lengths of the sides of particles. For this reason, the particles deposited exhibit a color-forming property corresponding to the lengths of the sides of the particles.

Figure 3A:
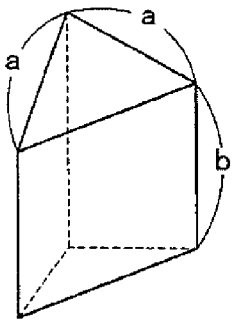
FIG. 3A is a perspective view schematically showing a triangular prism particle.
Figure 3B:
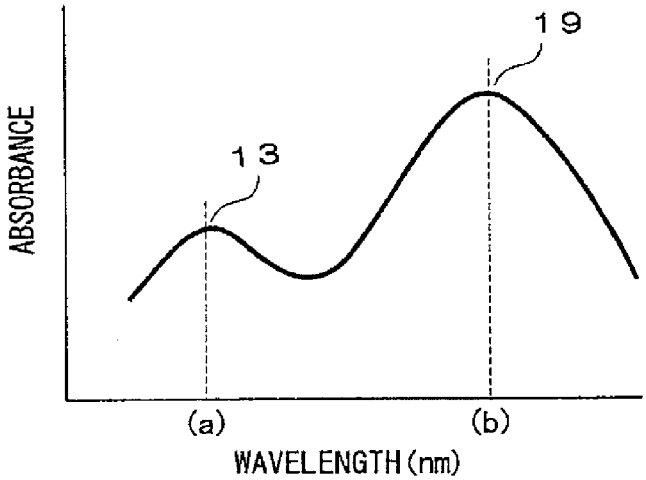
FIG. 3B is a graph showing light absorption peaks of the particle of FIG. 3A.

For example, as shown in FIG. 3A, when a particle deposited has a triangular prism shape with sides having a length (a) and sides having a length (b), the particle with the sides having different lengths exhibits two light absorption peaks: a light absorption peak 13 corresponding to the sides having a length (a) and a light absorption peak 19 corresponding to the sides having a length (b) as shown in FIG. 3B.

For this reason, when the particle deposited has a shape with sides having two or more different lengths as in a triangular prism particle, such a particle exhibits plural light absorption peaks having different wavelengths corresponding to the lengths of the sides.

Figure 4A:
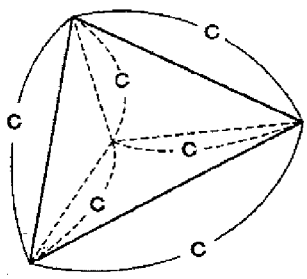
FIG. 4A is a perspective view schematically showing a silver triangular pyramid particle of the invention.
Figure 4B:
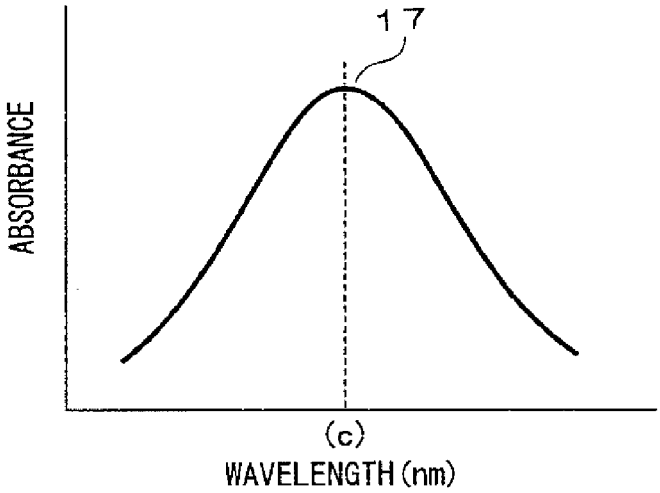
FIG. 4B is a graph showing a light absorption peak of the particle of FIG. 4A.

On the other hand, since the silver triangular pyramid particle of the invention has sides whose lengths are substantially the same (e.g. length (c)) in the respective triangular planes as shown in FIG. 4A, the silver triangular pyramid particle has only one light absorption peak 17 corresponding to sides having a length (c), as shown in FIG. 4B.

The color originating from the surface plasmon absorption depends on the lengths of the sides of a particle deposited. For this reason, it may be said that a particle with sides having more uniform lengths as in the silver triangular pyramid particles of the invention results in higher color-purity color-forming property than a particle with sides having uneven lengths.

The silver triangular pyramid particles of the invention may be used in display media and display device using color due to surface plasmon resonance. The silver triangular pyramid particles of the invention may also be used as the sensor portions of biosensors that detect the molecules of a living body such as DNA chips or protein chips, and, in other words, fractionates the molecules contained in a liquid sample and further detects the molecules fractionated. More specifically, the surfaces of the silver triangular pyramid particles of the invention are modified with molecules (e.g., complemental strand for DNA or antigen or antibody for protein), change in plasmon resonance which change is obtained by combining desired molecules of a living body with the silver surfaces is detected. The silver triangular pyramid particles of the invention may also be used as coloring materials for paints

EXAMPLES

Example 1

A silver triangular pyramid particle manufacturing apparatus 10 having a structure shown in FIG. 1 is fabricated in the following procedures.

First, a glass substrate having a thickness of 1 mm, a length of 3 cm and a width of 3 cm is prepared as a front surface. Tin oxide-indium oxide (ITO) is sputtered on the entire surface of the glass substrate to form a first electrode having a thickness of 200 nm.

As in the first electrode, tin oxide-indium oxide (ITO) is sputtered on the entire surface of a glass substrate that is the same as the aforementioned glass substrate and that serves as a rear substrate to form a second electrode having a thickness of 200 nm.

Then, silver iodide (manufactured by Aldrich Corporation) and lithium iodide (manufactured by Aldrich Corporation) are respectively dissolved in separate portions of dimethylsulfoxide (DMSO manufactured by Aldrich Corporation) to prepare solutions having concentrations of the respective components of 5 mmol/liter. Furthermore, the silver iodide solution and the lithium iodide solution are admixed so that the amounts of these solutions are equivalent. Thus, a mixture is obtained.

Moreover, hexadecyl trimethyl ammonium bromide with an alkyl chain having 16 carbon (C16) atoms is added as a surfactant to the mixture so that the concentration thereof in the resultant blend becomes 0.5 mmol/liter. Thereafter, tetradodecylammonium bromide with an alkyl chain having 12 carbon (C12) atoms is added as another surfactant to the blend so that the concentration thereof in the resulting admixture becomes 0.25 mmol/liter, whereby an electrolytic solution containing silver ions and surfactants is prepared.

Lead wires each having a suitable length are electrically connected to the first electrode and the second electrode, respectively, so as to enable application of a voltage thereto.

Next, a spacer having a height of 200 μm and made of a polyimide resin is disposed on the first electrode formed on the glass substrate serving as the front substrate such that the area of a portion of the first electrode on which portion a metal is to be deposited becomes 1.5 $cm^2$. At this time, the gap between the first electrode and the second electrode is 200 μm. Thereafter, the rear substrate is disposed on the spacer so that the first electrode faces the second electrode. Thus, a laminated body is obtained. Subsequently, an epoxy adhesive (ARALDITE manufactured by Huntsman Advanced Materials Corporation) is applied to all, but a part, of the circumference of the end surfaces of the laminated body and is then cured.

Then, the laminated body is filled with the electrolytic solution through a portion of the end surfaces of the laminated body which portion has not been sealed (an inlet for electrolytic solution).

The first electrode and the second electrode are electrically connected to a function generator (AFG 310 manufactured by Tektronix Corporation) serving as a voltage application unit through the respective lead wires so that signals can be sent and received between the function generator and the first and second electrodes. Further, the function generator is electrically connected to a personal computer serving as a controller. Such a configuration allows a voltage having any waveform to be applied to the electrolytic solution.

Next, the reduction potential of the silver ions dissolved in the electrolytic solution layer of the display medium thus prepared is measured.

The reduction potential is measured in accordance with a cyclic voltammetry (CV) technique under the following conditions.

Measuring Instrument: Electrochemical Analyzer (CHI 604A manufactured by ALS corporation)

Working Electrode/Counter Electrode: Pt electrodes

Reference Electrode Pt electrode

Sample Solution Electrolytic solution

Measuring Mode: DC

Scan Range: 1.0 to −1.50 V

Scan Rate: 0.1 V/s

Figure 5:
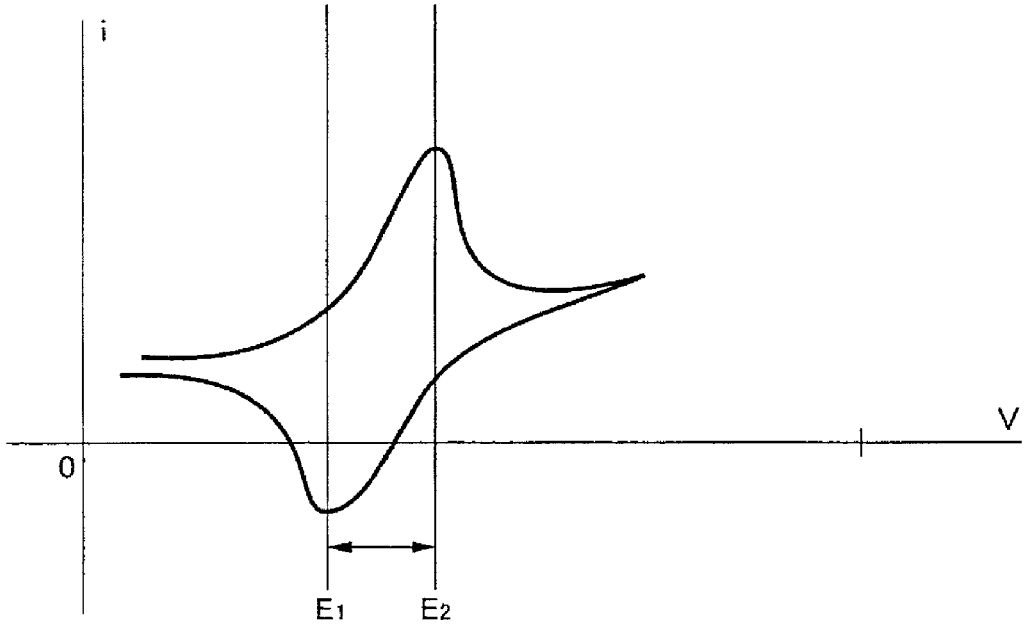
FIG. 5 is a graph showing an example of measured reduction potential data.
Figure 6:
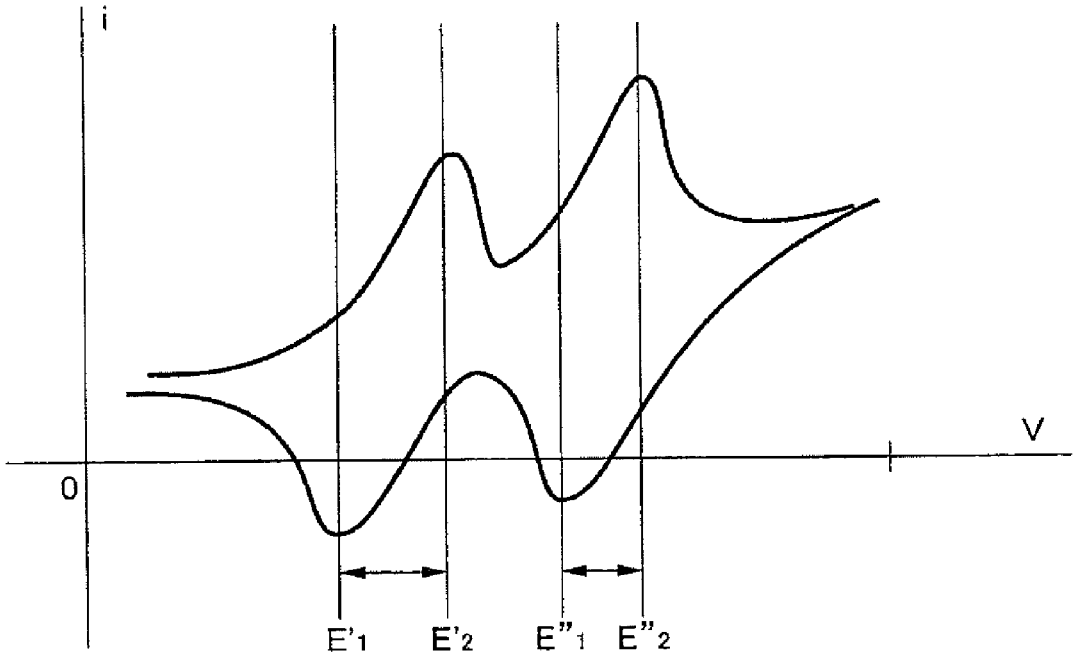
FIG. 6 is a graph showing another example of measured reduction potential data.

A method for analyzing data measured by the measuring instrument under the measuring conditions will be described. Specific examples of data measured under the above-described conditions are shown in FIGS. 5 and 6. In these graphs, the upper curve represents the reductive reaction of an oxidant, while the lower curve represents the oxidative reaction of a reductant.

In FIG. 5, the average value of electric potential E1 at which a peak appears in the lower curve and electric potential E2 at which a peak appears in the upper curve corresponds to the reduction potential.

$$\text{Reduction potential}=(E1+E2)/2$$

In the case where the curves each have plural peaks as shown in FIG. 6, the value of a larger reduction wave (one near to zero in FIG. 6) is regarded as the representative value. Namely, values E'1 and E'2 in FIG. 6 are adopted, and the average value thereof corresponds to the reduction potential.

$$\text{Reduction potential}=(E'1+E'2)/2$$

Figure 7:
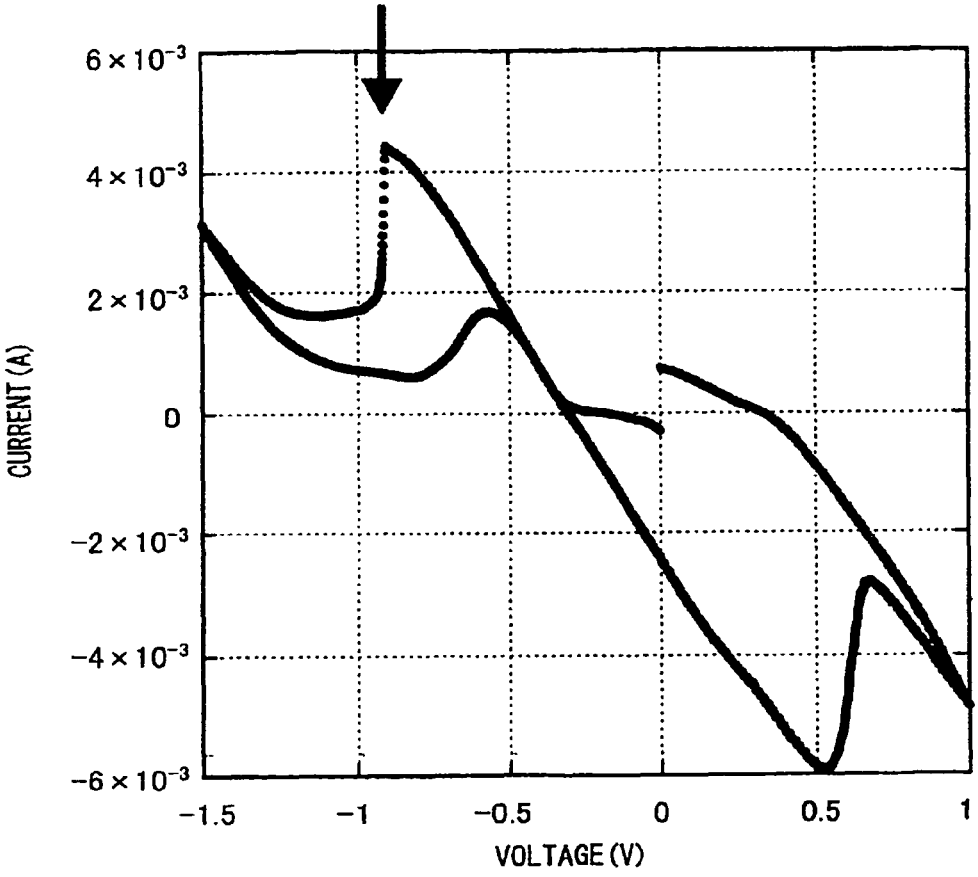
FIG. 7 is a diagram showing measured reduction potential data in Example 1.

The electrolytic solution prepared in Example 1 is used, and the reduction potential is measured in accordance with the aforementioned measuring method. Results shown in FIG. 7 are obtained. From the results, it has been found that the reduction potential, calculated in accordance with the analytic method, in the electrolytic solution is about −300 mV. In this example, however, the reduction potential is set to be about −900 mV, which is the peak value of the reductive reaction, to secure deposition.

Next, the minus terminal of the function generator serving as the voltage application unit is electrically connected to the first electrode, while the plus terminal of the function generator is electrically connected to the second electrode. Thereafter, a voltage having a rectangular waveform shown in FIG. 8 as a first voltage waveform is applied to the first and second electrodes.

Figure 8:
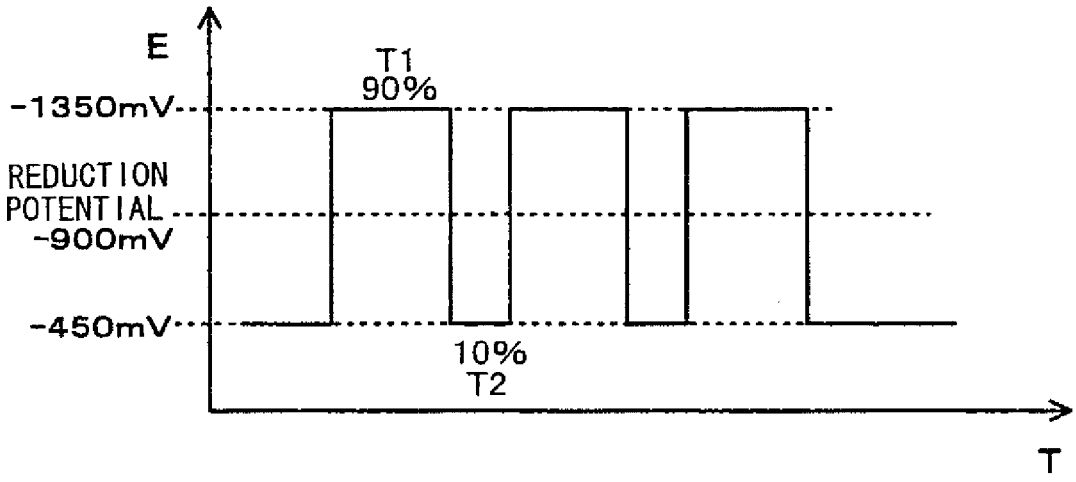
FIG. 8 is a diagram showing the first voltage waveform used in Examples 1 to 3 and Comparative Example 1.

In the rectangular waveform shown in FIG. 8, the electric potential corresponding to the half value line of the rectangular waveform (middle of pulse amplitude) is set to be −900 my, which is the reduction potential. Further, the measured results in FIG. 7 show that increase in potential values by applying a voltage of −1400 mV or less (application of a minus voltage whose absolute value is equal to or more than 1400 mV) is observed again. Accordingly, the pulse amplitude of the rectangular wave serving as the first voltage wave is set to be 900 mV not to apply a voltage of −1400 mV or less, e.g. −1600 mV. The frequency of the rectangular wave is 100 Hz; and a value represented by the numerical expression {T1×100/(T1+T2)}, in which T1 is the continuous voltage application time of deposition potential and T2 is the continuous voltage application time of dissolution potential, is set to be 90%.

The rectangular wave having the voltage waveform shown in FIG. 8 is applied to the electrolytic solution layer through the first electrode and the second electrode for 200 seconds. As a result, the first electrode is colored yellow. The absorption peak wavelength of the surface of the first electrode is measured with a spectrophotometer, U-4100 manufactured by Hitachi and is found to be about 500 nm. In this case, only one absorption peak is found. From this fact, the difference in length between the respective sides is thought to be 0 nm.

Figure 9:
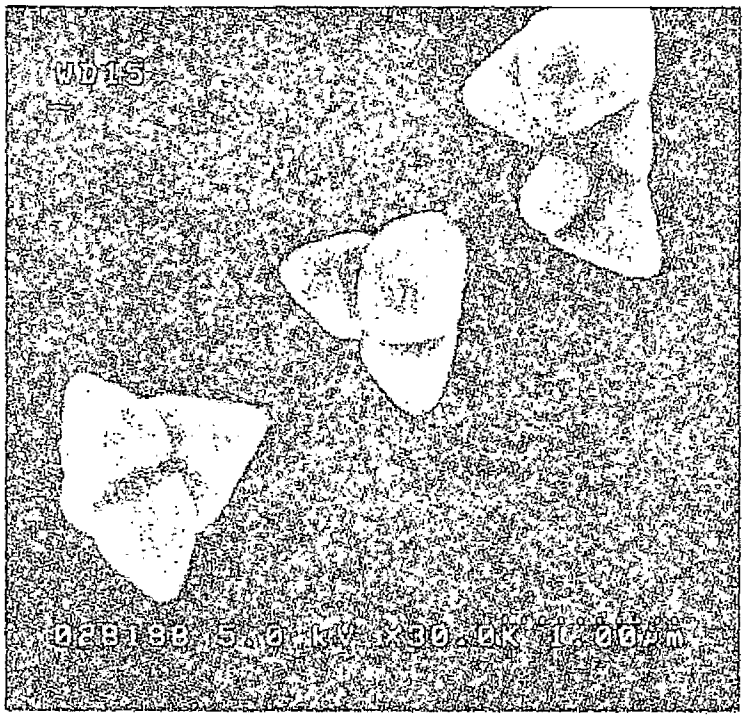
FIG. 9 is the scanning electron micrograph of the silver triangular pyramid particles deposited in Example 1 (power of thirty thousand times)

The surface of the first electrode is observed with a scanning electron microscope (FE-SEM S-4500 manufactured by Hitachi, Ltd. and having power of ten thousands to hundred thousand times). As a result, deposition of triangular pyramid particles each having sides of about 100 to about 300 nm is observed as shown in the photograph of FIG. 9 (power of thirty thousand times). Moreover, it is also observed that these particles aggregate into triangular pyramid particles of a higher-order structure.

As a result of analysis with an energy dispersive X-ray analyzer (EDX) of the FE-SEM, it has been confirmed that the particles deposited are made of silver. More specifically, it has been confirmed that the silver triangular pyramid particles deposited on the surface of the first electrode are obtained by reducing the silver ions in the electrolytic solution.

The length of sides of the particles is obtained as follows. Arbitrary five points on the surface of the first electrode are photographed with the scanning electron microscope (FE-SEM S-4500 manufactured by Hitachi, Ltd.) at power of 60 thousand times to obtain magnified images. The length of sides of particles in the magnified images is measured, and the actual length of the sides is calculated in consideration of the power.

As mentioned above, silver triangular pyramid particles can be manufactured in accordance with the method for manufacturing silver triangular pyramid particles of the invention.

Example 2

A silver triangular pyramid particle manufacturing apparatus is fabricated in the same manner as in Example 1, except that the surfactants, or hexadecyl trimethyl ammonium bromide and tetradodecylammonium bromide, are replaced with tetrabutylammonium bromide with an alkyl chain having 4 carbon atoms (C4) and tetraoctylammonium bromide with an alkyl chain having 8 carbon atoms (C8) and the concentration of the tetraoctylammonium bromide with an alkyl chain having 8 carbon atoms (C8) is 0.5 mmol/liter in preparing an electrolytic solution containing silver ions and surfactants. When a rectangular wave having the voltage waveform shown in FIG. 8 is applied to the electrolytic solution layer through the first electrode and the second electrode for 200 seconds in the same manner as in Example 1, the first electrode is colored pale yellow. The absorption peak wavelength of the surface of the first electrode is measured by the spectrophotometer U-4100 manufactured by Hitachi, and is found to be about 500 nm.

Figure 11:
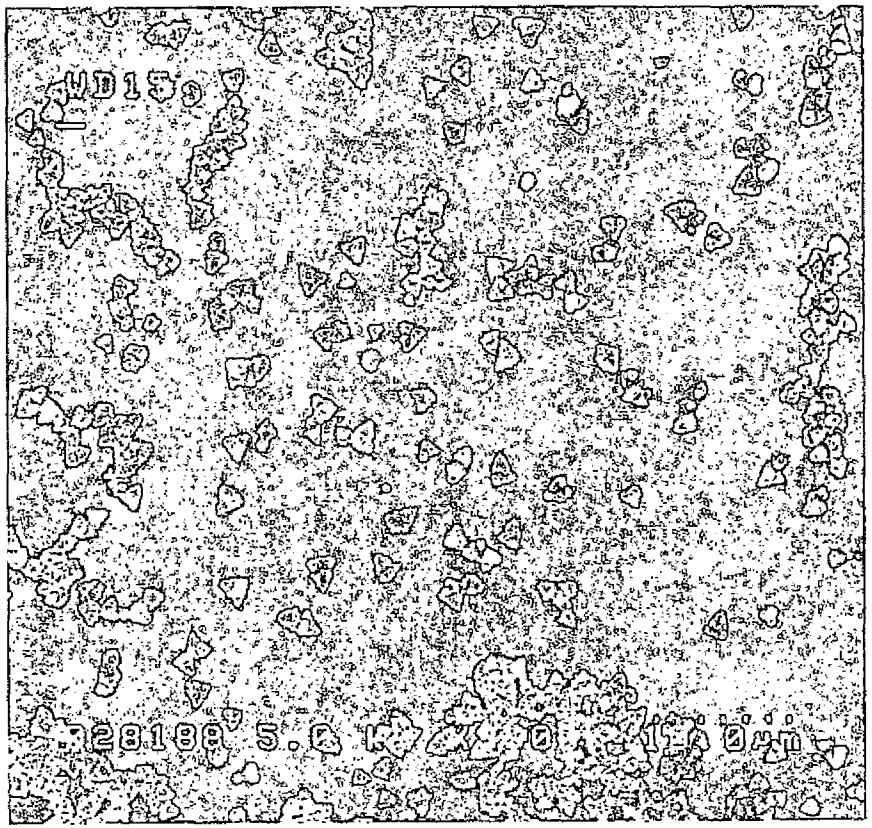
FIG. 11 is the scanning electron micrograph of the silver triangular pyramid particles deposited in Example 2 (power of three thousand times).

Furthermore, when the surface of the first electrode is observed with the scanning electron microscope (FE-SEM S-4500 manufactured by Hitachi, Ltd. and having power of ten thousands to hundred thousand times). As a result, deposition of triangular pyramid particles each having sides of about 100 to about 300 nm is observed as shown in the photograph of FIG. 11 (power of three thousand times). Moreover, it is also observed that these particles aggregate into triangular pyramid particles of a higher-order structure.

As a result of analysis with an energy dispersive X-ray analyzer (EDX) of the FE-SEM, it has been confirmed that the particles deposited are made of silver. More specifically, it has been confirmed that the silver triangular pyramid particles deposited on the surface of the first electrode are obtained by reducing the silver ions in the electrolytic solution.

The length of sides of the particles is obtained as follows. Arbitrary five points on the surface of the first electrode are photographed with the scanning electron microscope (FE-SEM S-4500 manufactured by Hitachi, Ltd.) at power of 60 thousand times to obtain magnified images. The length of sides of particles in the magnified images is measured, and the actual length of the sides is calculated in consideration of the power.

Example 3

A silver triangular pyramid particle manufacturing apparatus is fabricated in the same manner as in Example 1, except that the surfactants, or hexadecyl trimethyl ammonium bromide and tetradodecylammonium bromide, are replaced with sodium dodecylsulfate (SDS) having a sulfate group as a hydrophilic group and an alkyl chain with 12 carbon atoms (C12) and tetraoctylammonium bromide with an alkyl chain having 8 carbon atoms (C8), and the concentration of the tetraoctylammonium bromide with an alkyl chain having 8 carbon atoms is 0.5 mmol/liter in preparing an electrolytic solution containing silver ions and surfactants. When a rectangular wave having the voltage waveform shown in FIG. 8 is applied to the electrolytic solution layer through the first electrode and the second electrode for 200 seconds in the same manner as in Example 1, the first electrode is colored pale yellow. The absorption peak wavelength of the surface of the first electrode is measured by the spectrophotometer U-4100 manufactured by Hitachi, and is found to be about 500 nm.

Furthermore, when the surface of the first electrode is observed with the scanning electron microscope (FE-SEM S-4500 manufactured by Hitachi, Ltd. and having power of ten thousands to hundred thousand times). As a result, deposition of triangular pyramid particles each having sides of about 100 to about 300 nm is observed. Moreover, it is also observed that these particles aggregate into triangular pyramid particles of a higher-order structure.

As a result of analysis with an energy dispersive X-ray analyzer (EDX) of the FE-SEM, it has been confirmed that the particles deposited are made of silver. More specifically, it has been confirmed that the silver triangular pyramid particles deposited on the surface of the first electrode are obtained by reducing the silver ions in the electrolytic solution.

The length of sides of the particles is obtained as follows. Arbitrary five points on the surface of the first electrode are photographed with the scanning electron microscope (FE-SEM S-4500 manufactured by Hitachi, Ltd.) at power of 60 thousand times to obtain magnified images. The length of sides of particles in the magnified images is measured, and the actual length of the sides is calculated in consideration of the power.

Comparative Example 1

A silver triangular pyramid particle manufacturing apparatus is fabricated in the same manner as in Example 1, except that the surfactants, or hexadecyl trimethyl ammonium bromide and tetradodecylammonium bromide, are not used in preparing an electrolytic solution containing silver ions and surfactants. When a rectangular wave having the voltage waveform shown in FIG. 8 is applied to the electrolytic solution layer through the first electrode and the second electrode for 200 seconds in the same manner as in Example 1, the first electrode is colored pale gray. The absorption peak wavelength of the surface of the first electrode is measured by the spectrophotometer U-4100 manufactured by Hitachi, and is found to be about 410 nm, and the peak is broad.

Figure 10:
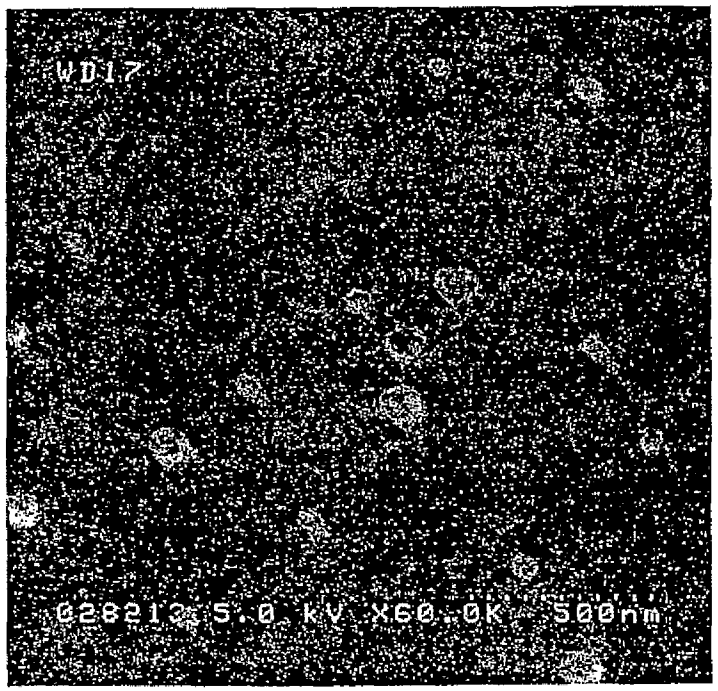
FIG. 10 is the scanning electron micrograph of the particles deposited in Comparative Example 1 (power of sixty thousands times)

Furthermore, when the surface of the first electrode is observed with the scanning electron microscope (FE-SEM S-4500 manufactured by Hitachi, Ltd. and having power of ten thousands to hundred thousand times). As a result, deposition of spherical particles each having sides of about 20 to about 50 nm is observed as shown in the photograph of FIG. 10 (power of sixty thousands times).

As a result of analysis with an energy dispersive X-ray analyzer (EDX) of the FE-SEM, it has been confirmed that the particles deposited are made of silver. More specifically, it has been confirmed that the silver spherical particles deposited on the surface of the first electrode are obtained by reducing the silver ions in the electrolytic solution.

The length of sides of the particles is obtained as follows. Arbitrary five points on the surface of the first electrode are photographed with the scanning electron microscope (FE-SEM S-4500 manufactured by Hitachi, Ltd.) at power of 60 thousand times to obtain magnified images. The length of sides of particles in the magnified images is measured, and the actual length of the sides is calculated in consideration of the power.

As described above, the method for manufacturing silver triangular pyramid particles of the invention enables manufacture of triangular pyramid particles.

What is claimed is:

1. A method for manufacturing silver triangular pyramid particles comprising:

forming an electric field between electrodes in an electrolytic solution including silver ions and a surfactant to reduce the silver ions into silver triangular pyramid particles, the silver triangular pyramid particles being silver tetrahedron particles, wherein the silver tetrahedron particles have only one light absorption peak corresponding to sides whose lengths are substantially the same (length (c)) in respective triangular planes, each of the silver tetrahedron particles has only four triangular faces, the surfactant is a salt with an alkyl main-chain of 1 to 20 carbons, and a substrate of the electrode is metal oxide.

2. The method according to claim 1, wherein an amount of the surfactant is 1 to 10,000 parts by weight relative to 100 parts by weight of the silver ions in the electrolytic solution.

3. The method according to claim 2, wherein the silver triangular pyramid particles have a surface plasmon absorption peak in a visible light region.

4. The method according to claim 1, wherein the silver triangular pyramid particles have a surface plasmon absorption peak in a visible light region.

* * * * *